US007299663B2

(12) United States Patent
Ackermann et al.

(10) Patent No.: US 7,299,663 B2
(45) Date of Patent: Nov. 27, 2007

(54) WASHING MACHINE

(75) Inventors: Uwe Ackermann, Schönwalde (DE); Raymond Römer, Berlin (DE); Horst Wiemer, Kleinmachnow (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 517 days.

(21) Appl. No.: 10/911,952

(22) Filed: Aug. 4, 2004

(65) Prior Publication Data

US 2005/0028565 A1 Feb. 10, 2005

(30) Foreign Application Priority Data

Aug. 4, 2003 (DE) ..... 103 35 623

(51) Int. Cl.
*D06F 39/08* (2006.01)

(52) U.S. Cl. ..... 68/3 R; 68/184; 68/208

(58) Field of Classification Search ..... 68/3 R, 68/184, 208
See application file for complete search history.

(56) References Cited

U.S. PATENT DOCUMENTS 1,997,069 A * 4/1935 More et al. ..... 384/149
2,350,108 A * 5/1944 Geldhof et al. ..... 68/12.01
2,352,363 A * 6/1944 Bassett, Jr. ..... 68/23.1
2,649,705 A * 8/1953 Ott ..... 68/140
2,712,228 A * 7/1955 Lloyd-Kessel ..... 68/3 R
2,758,461 A * 8/1956 Tann ..... 68/19.1
2,785,558 A * 3/1957 Broderick ..... 68/22 A
2,798,302 A * 7/1957 Reiter ..... 34/543
2,866,273 A * 12/1958 Geldhof ..... 34/75
3,257,736 A * 6/1966 Lachat et al. ..... 34/443
4,307,588 A * 12/1981 Smith et al. ..... 68/23.7
4,324,035 A * 4/1982 Sherer et al. ..... 29/434
4,572,596 A * 2/1986 Weir et al. ..... 312/257.1
5,584,549 A * 12/1996 Lybarger et al. ..... 312/265
6,460,949 B2 * 10/2002 Jung ..... 312/228

FOREIGN PATENT DOCUMENTS

FR 2 717 509 * 9/1995
JP 5-161779 * 6/1993

* cited by examiner

*Primary Examiner*—Frankie L. Stinson
(74) *Attorney, Agent, or Firm*—Russell W. Warnock; Craig J. Loest; James E. Howard

(57) ABSTRACT

The shaft axis of a detergent-solution pump in a washing machine is pivoted about a vertical such that, as seen in the forward direction, it forms an acute angle α with a perpendicular center plane running from the front surface to the rear wall of the machine housing. The drain connector for the drain hose from the tub to the pump is oriented on the tub casing with an angular offset in the preferred spinning direction of rotation in relation to the vertical plane running through the drum axis. These measures give rise to better accessibility to the pump chamber and to improved pumping capacity, in particular for foam/water mixtures. The pump-out operation is shortened, and the overall height of the pump-out system can be reduced.

6 Claims, 2 Drawing Sheets

WASHING MACHINE

BACKGROUND OF THE INVENTION

Field of the Invention

The present invention relates to a washing machine, or a laundry treatment machine, containing a tub, in which a laundry drum is mounted such that it can be rotated about a horizontal or an inclined axis which slopes up in the forward direction, and a liquid pump-out system containing a pump for discharging a liquid which has been used in the washing machine. The pump chamber is accessible from the front surface of a cabinet-type outer housing of the washing machine.

The tub with the drum and the drive assembly thereof form a vibratory system, which is suspended resiliently on the frame of the washing machine and is supported by means of suitable shock absorbers against the same. For the outflow from the tub, a drainage opening is present at the lowest-level location. The fluid connection between the tub and the detergent-solution pump is produced via a drain hose. The latter has the additional task of mechanically decoupling the detergent-solution pump, which is fixed to the appliance housing, and the resiliently suspended tub to the extent where the vibratory load that stems from the tub during operation of the washing machine and to which the detergent-solution pump is subjected can be restricted to a minimum.

In prior art washing machines, the detergent-solution pumps which are regularly used are centrifugal pumps, which, in principle, have a poor intake behavior. The detergent-solution pump in the washing machine and the feed line are thus arranged beneath the level of the tub, in such a manner that there is always a sufficient slope in the conveying direction and the operating liquid can flow to the pump solely by way of its gravitational force. On account of the resulting lack of space in the washing machine, the detergent-solution pump is arranged predominantly in a region in the vicinity of the base plate and of one of the side walls.

The delivery capacity of the pump-out system, under otherwise identical conditions, is dependent on the inside width of the individual components and on the slope of the tub-outlet opening to the detergent-solution pump, and on the line guidance. This applies, in particular, to the pumping-out phases in which a mixture of liquid and foam is to be delivered. In washing machines of which the drum volume, with predetermined dimensions of the appliance housing, has been extended to the limits of what is technically possible, in order to increase the quantity of laundry which can be accommodated in a washing cycle, the amount of free space available for installing the pump-out system is vastly constricted. This gives rise to design problems in the configuration of the pump-out system, the size of the individual parts cannot be selected as desired, and the possibilities of configuring the pump-out system with the necessary slope are limited.

In order to protect the detergent-solution pump against wear and to prevent breakdowns, the detergent-solution pump has a lint filter disposed upstream of it, this filter collecting foreign bodies and torn-off laundry accessories as well as abraded textile material. The lint filter requires cleaning by the customer at regular intervals. Access can be gained to the lint filter, and the detergent-solution pump can be inspected, via an opening in the front paneling, directly behind which the detergent-solution pump is disposed. For this purpose, the user always has to assume a stooped posture since, for the reasons described above, the detergent-solution pump is usually arranged at a very low-level location in the appliance. In order to render maintenance more convenient for the customer, many manufacturers have taken to arranging the detergent-solution pump in a state in which it is pivoted about a horizontal, perpendicularly to the axis of the detergent-solution pump, such that it slopes up in the direction of the front side. This results in a more favorable viewing angle for the user, the lint filter and the detergent-solution pump are easier to see, the causes of disruption to the detergent-solution pump can be detected more readily, and the maintenance work is easier to carry out overall. The disadvantage is that, even by virtue of this improved installation, if the machine is set up in unfavorable space conditions, access to the detergent-solution pump remains difficult, e.g. if the washing machine has the side wall behind which the detergent-solution pump is arranged set up against a room wall.

SUMMARY OF THE INVENTION

It is accordingly an object of the invention to provide a washing machine, which overcomes the above-mentioned disadvantages of the heretofore-known devices and methods of this general type and which renders it easier to inspect the detergent-solution pump and gain access to the lint filter. The intention here is for drainage systems known from the prior art to be further developed such that they can be realized by straightforward means.

With the foregoing and other objects in view there is provided, in accordance with the invention, a washing machine, comprising:

a cabinet-type outer housing having a front face and a rear wall;

a tub disposed in said housing, and a laundry drum rotatably mounted in said tub about a substantially horizontal axis or about an inclined axis sloping upwardly in a forward direction;

a pump-out system including a pump for discharging a liquid from the washing machine;

said pump being disposed in a chamber accessible from said front face of said outer housing; and said pump having a pump shaft with an axis pivoted about a vertical such that, as seen in a forward direction, said pump shaft axis encloses an acute angle with a perpendicular center plane of said outer housing running from said front face to said rear wall.

In other words, the objects of the invention are achieved in that the axis of the pump shaft is pivoted about a vertical such that, as seen in the forward direction, it forms an acute angle with a perpendicular center plane of the outer housing running from the front surface to the rear wall. The detergent-solution pump according to the invention is thus considerably easier for the user to see, to access, and to maintain as compared with detergent-solution pumps which, according to the prior art, are fitted at a large distance in the outward direction, namely directly alongside a lateral wall of the housing of the washing machine, which then possibly even stands directly alongside a wall of the room in which it is set up, and are installed at right angles, or only at an upwardly directed angle, in relation to the front side of the washing machine.

It is because, since the detergent-solution pump is arranged in a state in which it is pivoted in the direction of the loading opening, it is oriented away from the lateral wall and can easily be seen by a user who is standing directly in front of the loading opening. The more favorable viewing angle of the detergent-solution pump which is gained as a result facilitates monitoring of the pump even if the washing machine is set up in unfavorable space conditions.

In a further configuration of the invention, in the case of a washing machine of which the laundry drum is equipped such that it can be driven for spinning purposes, and of which the tub is connected by a drain connector, via a drain hose, to an intake connector on the pump, the intake connector being at a lower level than the drain connector, it is provided that the drain connector is inclined at an angle on the tub casing such that, in an at least preferably maintained direction of rotation in which the laundry drum spins, it assists the drainage of spun-off water. The flow conditions in the pump-out system and thus the delivery capacity are consequently improved and, moreover, there is the advantage of a reduced overall height for the pump-out system.

A significant advantage of this configuration is that the drain hose is fitted on the tub at an angle which is more favorable, in terms of flow, for the spun-off detergent solution. As is also the case with the special design of the drain hose which, according to an advantageous development of the invention, is guided from the drain connector to the intake connector over the smallest possible number of continuous curves, this has an advantageous effect in particular in those pumping-out phases in which a mixture of water and foam is to be delivered. If the drain hose is of the same width as without this development, the through-passage speed of the water/foam mixture is greater, and the pumping-out operation is shortened.

The greatest benefit to the user of a washing machine according to the invention can be achieved in that the axis of the pump shaft is located on the front surface at an angle in relation to the horizontal. It is then easiest to gain access to, and inspect, the pump chamber from its open access covering.

Other features which are considered as characteristic for the invention are set forth in the appended claims.

Although the invention is illustrated and described herein as embodied in a washing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
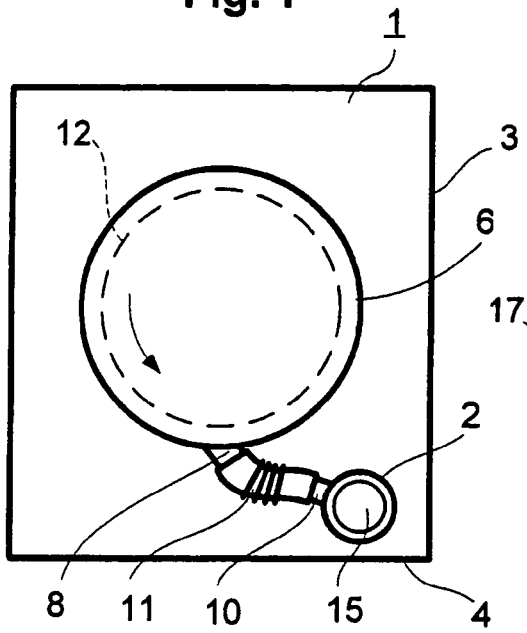
FIG. 1 is a schematic front view of a washing machine according to the invention, with a view of the tub and detergent-solution pump.

The exemplary embodiment selected is a front-loading washing machine with a housing 1 with a front wall 5, side wall 3 and rear wall 17 and also with an inclined vibratory system comprising a tub 6 and a laundry drum 12 mounted in a rotatable manner therein, i.e. a washing machine with a front loading opening, covered by a door 14, and a drum axis 7 which slopes up in the direction of the loading opening. In order to simplify the illustration, and to restrict it to the bare essentials, details have been omitted from the figures as far as possible.

Figure 2:
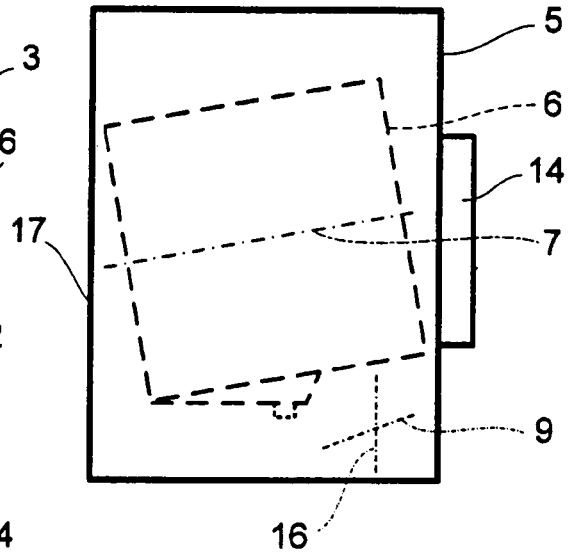
FIG. 2 is a corresponding schematic left-side view of the washing machine according to FIG. 1.
Figure 3:
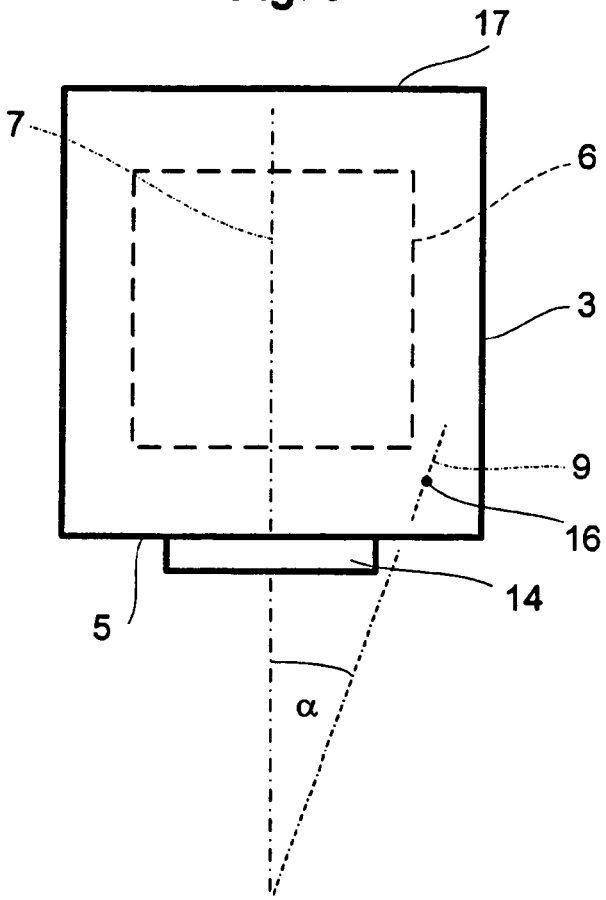
FIG. 3 is a corresponding schematic top plan view of the washing machine according to the invention.

Directly behind the front wall 5, and in the immediate vicinity of a side wall 3, the detergent-solution pump 2, also referred to as a wash water pump or pump, for short, is fastened on the base plate 4 of the washing-machine housing 1. The detergent-solution pump 2, in accordance with the illustration of its axis of rotation 9 in FIG. 2, is raised in the forward direction and, according to FIG. 3, is additionally pivoted about a vertical axis 16 in the direction of the center of the appliance. As a result, its center axis encloses an acute angle $\alpha$ with the perpendicular center plane along which the drum axis 7 is disposed. The access covering 15 of the detergent-solution pump 2, this covering being visible in FIG. 1, is thus positioned closer towards the center of the front wall, which improves the view of, and access to, the detergent-solution pump 2 if the washing machine is set up in unfavorable conditions.

In contrast to the conventional configuration, the drain connector 8 on the tub 6, rather than being directed vertically downward, is pivoted away at an angle in the main direction of rotation in which the laundry drum 12 spins. (arrow direction). The fluid connection between the tub 6 and detergent-solution pump 2 is realized via a vibrationally elastic hose 11. The drain hose 11 and the course over which it is guided from the tub 6 to the detergent-solution pump 2 can be gathered from FIGS. 1 and 4. The drain hose 11 is installed with a necessary slope. It is produced from an elastic material (e.g. rubber) and has as least one corrugated portion in order for the vibrational elasticity to be additionally improved. The two ends are angled by way of slight curves such that they allow continuous flow from the drain connector 8 on the tub 6 to the intake connector 10 of the detergent-solution pump 2 and are connected in a mechanically fixed and liquid-tight manner to the same.

In the same way as with the way in which the drain connector 8 is oriented according to the invention on the tub 6, this measure has an advantageous effect on the pumping capacity, in particular in the case of a mixture which is to be delivered comprising foam and water, and in particular in the case of a drain connector 8 which is pivoted away from the vertical in the spinning direction of rotation. The entire pump-out operation thus proceeds in a very short period of time. The intake connector 10 of the detergent-solution pump 2 for the connection of the drain hose 11 is directed toward the center of the pump chamber. In conjunction with the configuration according to the invention of the drain hose 11 and of the drain connector 8 on the tub 6, it is thus possible to achieve a minimal overall height for the pump-out system as a whole.

Figure 4:
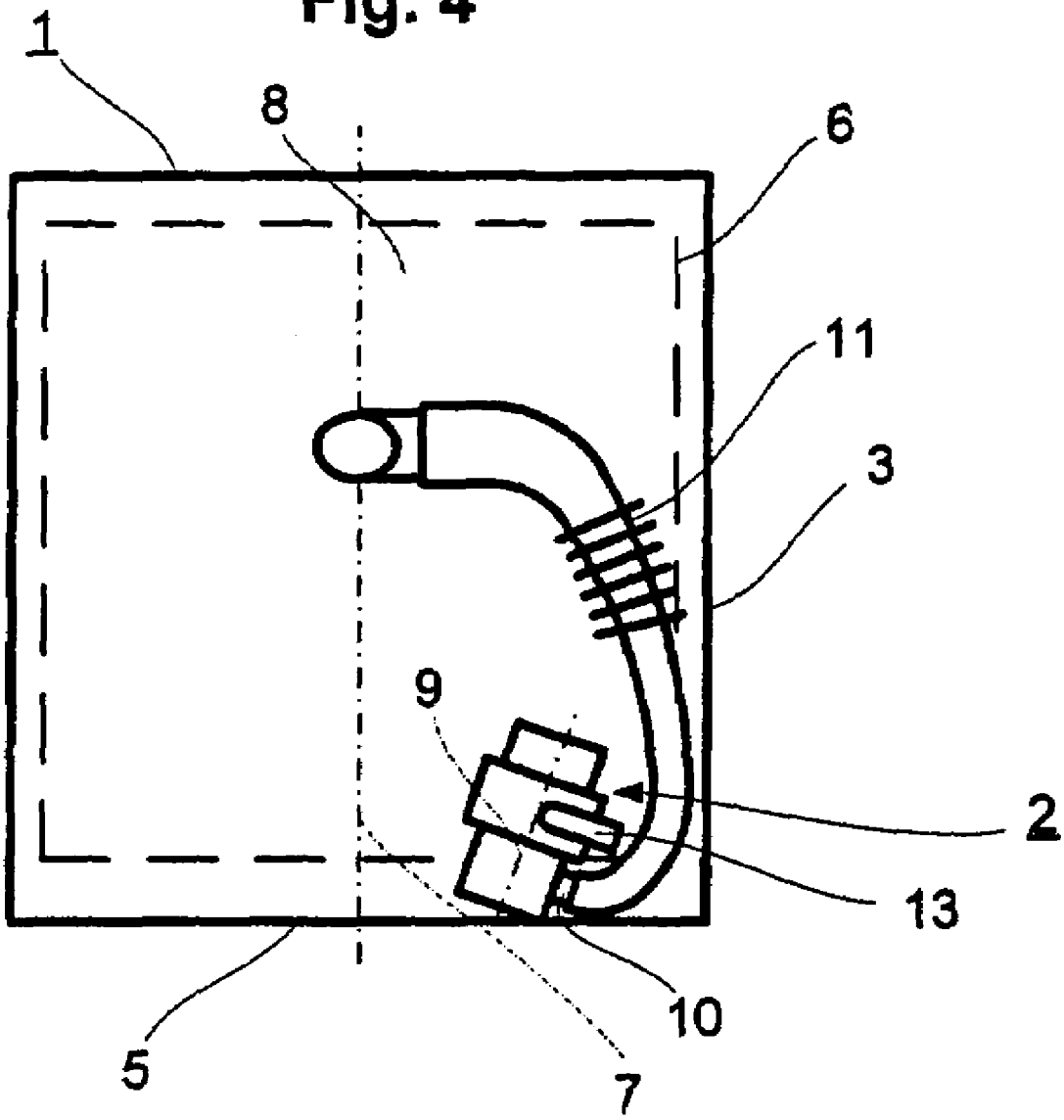
FIG. 4 is a schematic top plan view of the washing machine, with the top panel removed.

In the case of the top view of the washing machine which is illustrated in FIG. 4, it is possible, with the work top removed, to see into the machine. The tub 6, which covers the subassemblies installed on the base of the washing machine is illustrated here merely by way of an interrupted line, with the result that it is possible to see the pump-out system of the washing machine installed just above the base plate. This view shows the drain hose 11 formed to promote favorable flow, the hose being connected to the drain connector 8, angled obliquely to the right, and being guided over gentle curves to the intake connector 10 of the detergent-solution pump 2, this connector being located on the side of the antechamber provided for the filter device. The detergent solution, finally, can be removed from the washing machine via the delivery connection 13 (FIG. 4) of the detergent-solution pump 2 and a non-illustrated pump-out hose. By virtue of the detergent-solution pump 2 being pivoted in the direction of the center of the front side 5, this is easily accessible from the front, even if the washing machine has its right-hand side wall 3 moved up flush against a wall.

The advantages which can be achieved by the invention work to their full effect in appliances in which the installation space for the pump-out system is vastly limited. As can be gathered from the exemplary embodiment described, the invention is very easy to implement. The outlay which is necessary is restricted to coordinating with one another the geometry of known components and/or the arrangement of the latter in relation to one another.

This application claims the priority, under 35 U.S.C. § 119, of German patent application No. 103 35 623.1, filed Aug. 4, 2003; the entire disclosure of the prior application is herewith incorporated by reference.

We claim:

1. A washing machine, comprising:

a cabinet-type outer housing having a front face and a rear wall;

a tub disposed in said housing, and a laundry drum rotatably mounted in said tub about a substantially horizontal axis or about an inclined axis sloping upwardly in a forward direction;

a pump-out system including a pump for discharging a liquid from the washing machine;

said pump being disposed in a chamber accessible from said front face of said outer housing;

said pump having a pump shaft with an axis pivoted about a vertical axis such that, as seen in a forward direction, said pump shaft axis encloses an acute angle with a perpendicular center plane of said outer housing running from said front face to said rear wall; and said tub having a tub casing and a drain connector;

wherein said drain connector is connected to said tub casing at an angle pivoted away from the vertical axis and in a direction of rotation of the laundry drum;

wherein the angle configures the drain connector to receive a substantially greater quantity of a mixture of foam and water than a drain connector mounted vertically.

2. The washing machine according to claim 1, wherein:

said laundry drum is configured to be driven in a spin cycle;

said pump is formed with an intake connector disposed at a lower level than said drain connector; and said tub communicates with said pump through a vibrationally elastic drain hose connected between said drain connector and said intake connector of said pump;

wherein said drain hose substantially reduces a quantity of vibrations transferred from said tub to said pump.

3. The washing machine according to claim 2, wherein said drain hose is guided from said drain connector to said intake connector over a smallest possible number of continuous curves.

4. The washing machine according to claim 2, wherein said drain hose includes a corrugated portion, said corrugated portion mechanically decoupling said tub from said pump.

5. The washing machine according to claim 1, wherein said pump shaft axis intercepts said front face at an angle relative to a horizontal.

6. The washing machine according to claim 1, wherein said pump includes an intake connector and a pump chamber, wherein said intake connector directs fluid from a drain hose coupled to said intake connector toward the center of said pump chamber.

* * * * *